United States Patent [19]

Sakwa

[11] 4,336,882

[45] Jun. 29, 1982

[54] PEN PILL CONTAINER

[76] Inventor: Sydney M. Sakwa, 83 Ivy Hill Dr., Aberdeen, N.J. 07747

[21] Appl. No.: 1,666

[22] Filed: Jan. 8, 1979

[51] Int. Cl.[3] ..... B65D 83/04; B65D 85/42

[52] U.S. Cl. ..... 206/537; 206/459; 220/4 C; 220/23; 40/334

[58] Field of Search ..... 40/334; 206/38, 459, 206/528, 534–538, 546; 220/4 C, 4 D, 20, 23; 401/52, 89, 195

[56] References Cited

U.S. PATENT DOCUMENTS

| | | | |
|---|---|---|---|
| 1,255,671 | 2/1918 | Vaughn et al. | 401/195 |
| 1,271,430 | 7/1918 | Bush | 206/38 R UX |
| 1,307,359 | 6/1919 | Hugetz | 401/195 X |
| 2,354,402 | 7/1944 | Petruccione et al. | 220/4 D UX |
| 2,458,063 | 1/1949 | Dulberg | 401/52 X |
| 2,707,552 | 5/1955 | Matthiesen | 206/537 |
| 2,817,451 | 12/1957 | Giles et al. | 222/480 X |
| 2,931,539 | 4/1960 | Maxey | 222/192 X |
| 3,081,137 | 3/1963 | Kolokythas | 220/23 X |
| 3,446,179 | 5/1969 | Bender | 206/534 X |
| 4,094,408 | 6/1978 | Ford | 206/535 X |

FOREIGN PATENT DOCUMENTS

| | | | |
|---|---|---|---|
| 2215967 | 10/1973 | Fed. Rep. of Germany | 401/52 |
| 615468 | 1/1961 | Italy | 220/23 |
| 223559 | 2/1943 | Switzerland | 206/38 |
| 178285 | 4/1922 | United Kingdom | 401/52 |
| 506789 | 5/1939 | United Kingdom | 206/38 |

*Primary Examiner*—Herbert F. Ross
*Attorney, Agent, or Firm*—Howard I. Podell

[57] ABSTRACT

A container in the form of a pocket pen which is formed with a plurality of compartments for containment of medical pills and is fitted with a container for dispensing of powders such as dietetic salt or sugar substitutes. The device appears to be in the form of a conventional pocket pen fitted with a conventional removable cap section. A pill chamber in the cap section is capped by a removable hollow plug unit at the end of the cap section for containment and dispensing of powder. The plug unit is fitted with an external rotatable cover formed in one radial section of the cover with perforations and with the external cover rotatably joined to an interior cover by a rivet with an opening in the interior cover located so that the exterior cover may be rotated so as to either close the opening of the interior cover or to align that opening with the perforations of the external cover. The body section of the device is formed with two pill chambers separated by a transverse fixed partition, with one pill chamber capped by a removable plug unit incorporating a ball point and the other pill chamber capped by a removable hollow plug unit similar to that of the cap section for containment and dispensing of powder. Each of the three plug units is formed with a flange on which numerals, separating hours of the day, are marked, and fixed indicia are located on the exterior of the body and cap sections so as to align with a numeral of a plug flange.

2 Claims, 5 Drawing Figures

PEN PILL CONTAINER

PRIOR ART

The following listed U.S. Patents disclose various forms of pill holders that are shaped in the form of a pocket pen: Nos. 2,060,406; 2,718,299; 2,759,598; 3,199,668; 3,762,539; 3,968,902. However, none of these patents suggest the features of this invention, as described herein.

SUMMARY OF THE INVENTION

My invention is a container in the form of a pocket pen which is formed with a plurality of compartments for containment of medical pills and is fitted with a container for dispensing of powders such as dietetic salt or sugar substitutes.

The device appears to be in the form of a conventional pocket pen fitted with a conventional removable cap section. A pill chamber in the cap section is capped by a removable hollow plug unit at the end of the cap section for containment and dispensing of powder. The plug unit is fitted with an external rotatable cover formed in one radial section of the cover with perforations and with the external cover rotatably joined to an interior cover by a rivet with an opening in the interior cover located so that the exterior cover may be rotated so as to either close the opening of the interior cover or to align that opening with the perforations of the external cover.

The body section of the device is formed with two pill chambers separated by a transverse fixed partition, with one pill chamber capped by a removable plug unit incorporating a ball point and the other pill chamber capped by a removable hollow plug unit similar to that of the cap section for containment and dispensing of powder.

Each of the three plug units is formed with a flange on which numerals, separating hours of the day, are marked, and fixed indicia are located on the exterior of the body and cap sections so as to align with a numeral of a plug flange.

A particular feature of my pill container is the separate plug containers for dispensing of powder such as dietetic salt and sugar substitutes, which enable the user to readily dispense such powders as necessary. Each such plug container also serves as a removable cap for an individual pill chamber, with the flange of each plug container externally marked with numerals so that a flange numeral may be set adjacent a fixed external indicator on the cap or pen body to indicate the hour at which pills from each chamber are next to be taken, or alternatively have previously been taken, as desired. The exterior surface of the body and cap sections are roughened adjacent each chamber section so that the user may mark identification indicia corresponding to the medicine in the adjacent chamber.

The pill container of my invention fits the need of many active people who are under medical regimes that require periodic taking of a plurality of pills as well as the use of dietetic salt and sugar substitutes. Not only are a plurality of separate pills contained in individual chambers of the invention, but each chamber cap is fitted with an individual time indicator which is readily set to the appropriate time indicator when the user replaces the chamber cap.

The basic embodiment of the invention comprises three individual pill chambers, two powder dispensers and a ball-point pen unit. However, if the user desires additional compartments, two pen cap sections may be employed to each fastened about opposed ends of the body section to add an additional pill chamber and an additional powder dispenser.

While the two powder dispenser plugs are of similar construction, the external face of one is marked "SALT" and that of the other is marked "SWEET" to distinguish the respective contents.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
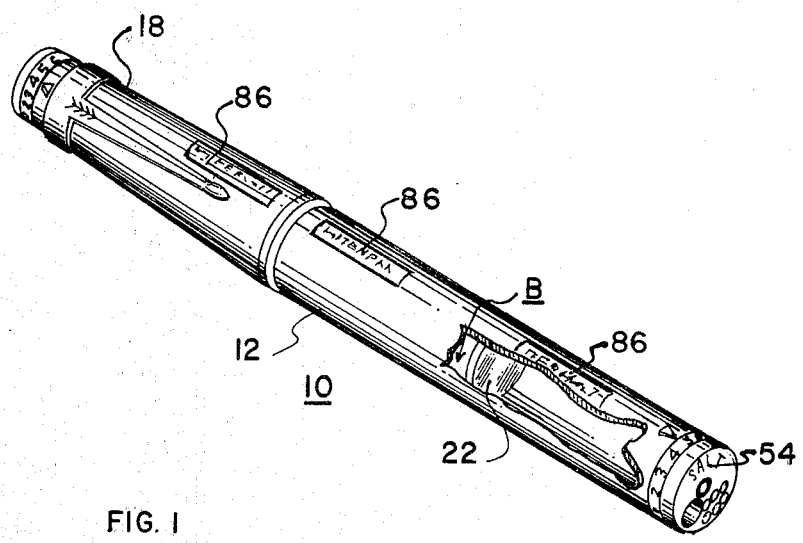
FIG. 1 is a perspective view of the device in the assembled mode.
Figure 2:
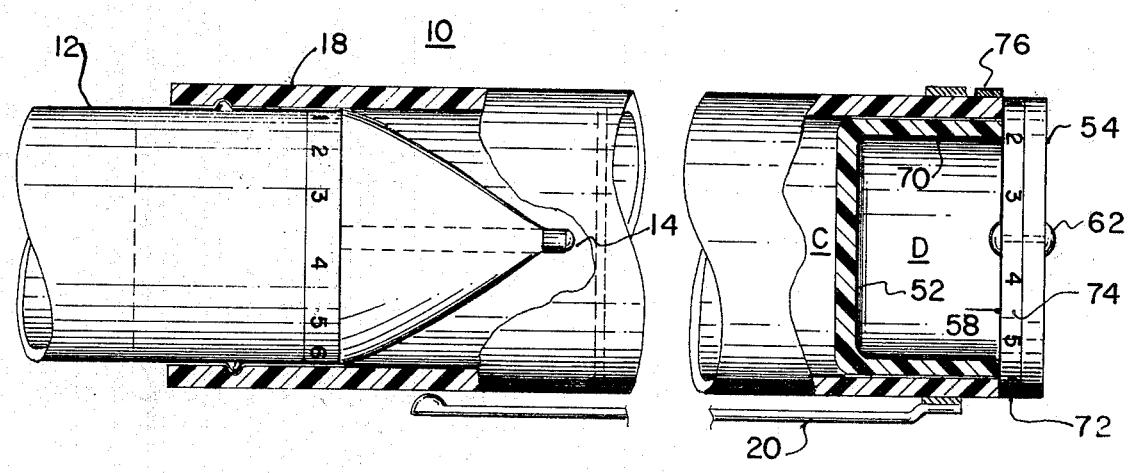
FIG. 2 is a detail sectional view of the pen cap section assembled to the body section.
Figure 4:
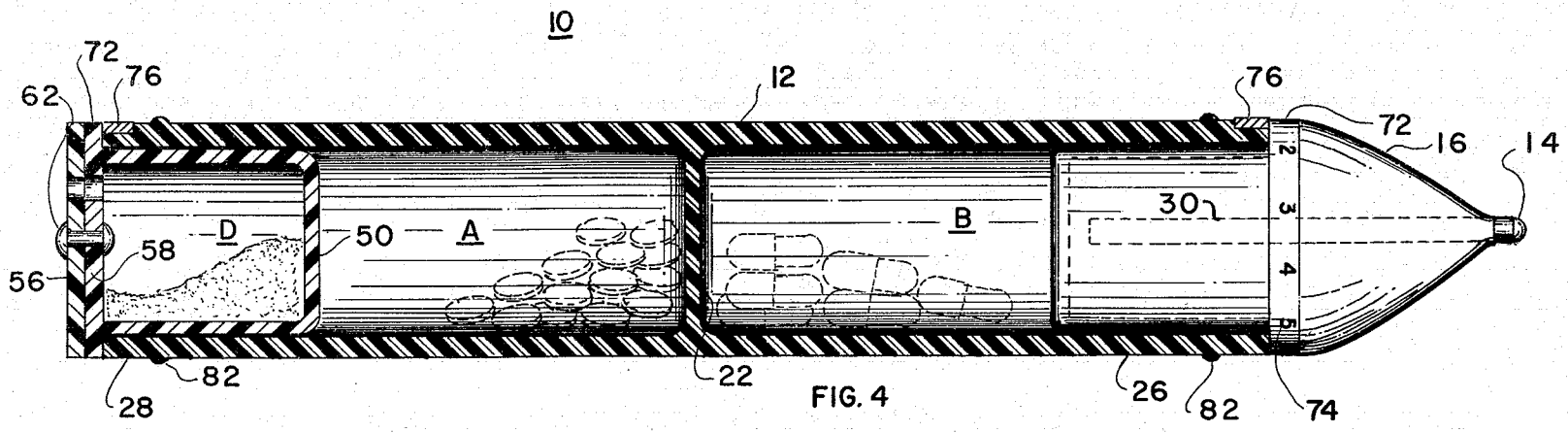
FIG. 4 is a sectional exploded view of the cap section.
Figure 3:
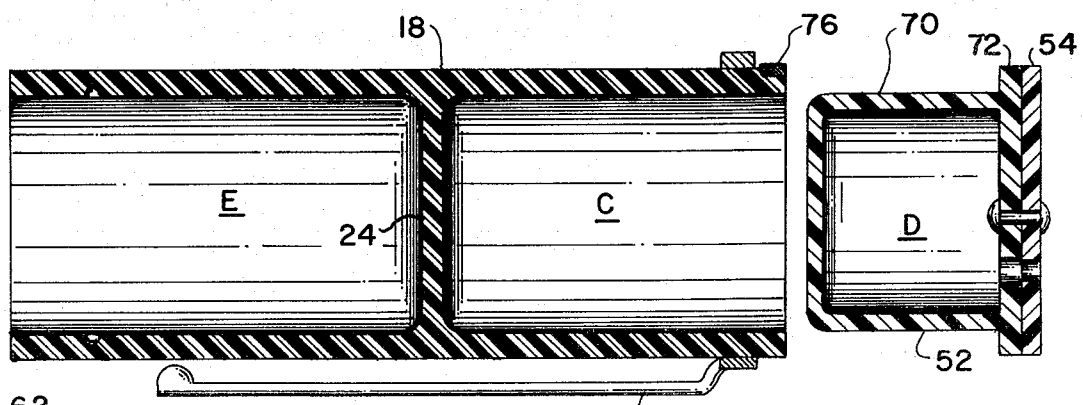
FIG. 3 is a sectional view of the body section.
Figure 5:
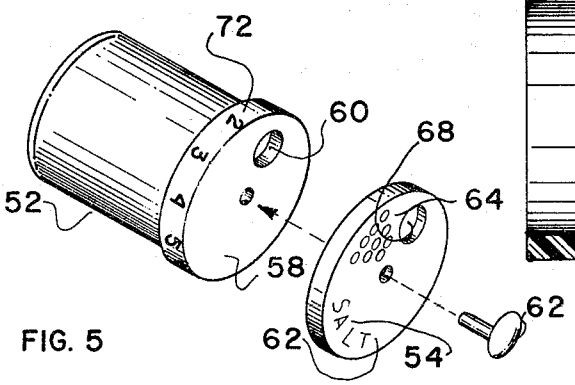
FIG. 5 is an exploded view of a hollow plug for containment and dispensing of powder.

Turning now descriptively to the drawings, in which similar reference characters denote similar elements throughout the several views, FIGS. 1–5 illustrate the pen pill container 10 which is formed of a body section 12, in one end of which a ball point pen 14 is fitted in a detachable plug unit 16, and a detachable cap section 18 fitted on its exterior with a clip 20 for fastening to an edge of a pocket of a garment.

Body section 12, of general tubular shape, is formed with a hollow interior divided by a transverse partition 22 into two chambers A and B with each chamber open at opposed ends of the barrel of body section 12, and with chamber A capped by removable plug unit 16, and chamber B capped by removable hollow plug unit 50.

Cap section 18 is of a tubular shape with the hollow interior separated by a transverse partition 24. The two interior chambers C and E are each open to opposed ends of the cap section, with chamber C capped by removable hollow plug unit 52 and open chamber E of a size to house the pen end 26 of body section 12 when the cap is fitted about end 26. Alternatively chamber E houses the end section 28 of the body section when cap 18 is fitted about body end 28 so as to permit the user to write with pen 14.

Removable plug unit 16 is fitted with a conventional ballpoint pen 14 that is fed by an internal reservoir tube 30 to which it is fitted. For purposes of replacement, tube 30 may be slid into and out of plug 16.

Removable hollow plug units 52 and 50 are of similar construction except for the identification indicia such as "SALT" or "SWEET", 54 and 56, respectively, externally marked on the face of each unit, and only unit 52 will be described hereinafter to describe both units.

Removable plug unit 52 is provided for containment and dispensing of powdered substance such as substitute sugar or dietetic salt. Plug 50 formed with an interior chamber D and with a first cover 58 permanently fixed to the wall of plug 50. An opening 60 is formed in first cover 58. A second cover 62 is mounted externally adjacent to cover 58 and rotatably joined to cover 58 by a rivet 62 or other blind fastener. A plurality of through small perforations 64 are formed in one radial section of cover 58 and an enlarged opening 68 of a size of opening 60 is formed in another radial section of cover 58. Alignment of openings 68 and 60 by rotation of cover 58 provides an opening into chamber D for filling chamber D with powdered material. Rotation of cover 58 so as to align perforations 64 with opening 60 enables the user to dispense the powdered material as desired on food or into a beverage. Rotation of cover 58 so as to completely block opening 60 serves to close chamber D. The external tubular wall 70 enclosing compartment D is of size to snugly fit into the interior of the opening of chamber C of the cap section or the end opening of end 28 of the body section. Plug unit 50 is formed with a circular flange section 72 projecting from wall 70 that extends beyond the wall 70 that the external surface of flange section 72 lies generally flush with the external surface of the cap or body section to which it is fitted. The external surface of flange section 72 is marked with numeral and other indicia 74 to indicate clock time and a fixed indicator 76 projects from the external surface of the cap or body section to align with one of the indicia 74 so as to alert the user as to the clock time when a pill in the chamber capped by the plug unit is to be taken, or has been taken.

A similar flange 72 extends from plug unit 16 so that indicia 74 may be similarly aligned with a fixed indicator 76.

Plug unit 16 and plug unit 50 may be formed with tubular bodies of different diameters with the interior of the end sections 26, 28 of the body sections formed of mating size interiors so that the pen unit 16 will only fit the interior of the opening of chamber B, with each plug unit snugly fitting in the opening of its respective end section.

An annular bead 82 is formed on the exterior of each end section 26, 28 so as to provide a friction fit against the inside surface of the cap section, when the cap section is fitted over an end of the body section.

The exterior surface of both the body section and the cap section may be roughened at patches 86 to enable the user to write on each patch 86 an identification of the medicine contained in the chamber adjacent each patch.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tubular dispenser fitted with a plurality of individual compartments for housing of pills, with each said compartment formed with an individual opening that is closed by an individual detachable plug unit, with at least one of said plug units shaped in the form of a hollow enclosed container adaptable for the storage and dispensing of powdered material such as dietetic salt or sweetener powder, with the interior of said hollow container closed by a cover fitted with a plurality of perforations for dispensing of powder, together with means to alternatively align said perforations with the interior of the said container or to alternatively block said perforations from communication with the said container interior.

2. The combination as recited in claim 1, in which the said hollow plug unit is formed with indicia on an external surface, together with a fixed indicator located on an external surface of an external wall of the compartment, the opening of which is closed by the said plug unit, such that an indicia on the plug unit may oriented adjacent to the said indicator to indicate a specific time associated with the use of medicine contained in the said compartment.

* * * * *